US010213361B2

(12) United States Patent
Ezenwa

(10) Patent No.: US 10,213,361 B2
(45) Date of Patent: Feb. 26, 2019

(54) MUSCLE FIBER EXCITATION SYSTEM FOR PREVENTING BLOOD CLOT AND MUSCULAR-SKELETAL DECLINE

(71) Applicant: Bertram Nworah Ezenwa, Mequon, WI (US)

(72) Inventor: Bertram Nworah Ezenwa, Mequon, WI (US)

( * ) Notice: Subject to any disclaimer, the term of this patent is extended or adjusted under 35 U.S.C. 154(b) by 253 days.

(21) Appl. No.: 15/251,753

(22) Filed: Aug. 30, 2016

(65) Prior Publication Data

US 2016/0367426 A1 Dec. 22, 2016

Related U.S. Application Data

(63) Continuation-in-part of application No. 14/277,028, filed on May 13, 2014, now abandoned.

(51) Int. Cl.
*A61H 23/02* (2006.01)
*A61H 1/00* (2006.01)

(52) U.S. Cl.
CPC ..... *A61H 23/0254* (2013.01); *A61H 1/005* (2013.01); *A61H 2201/0142* (2013.01); *A61H 2201/0149* (2013.01); *A61H 2201/0157* (2013.01); *A61H 2201/0165* (2013.01); *A61H 2201/1215* (2013.01); *A61H 2201/1418* (2013.01); *A61H 2201/164* (2013.01); *A61H 2201/165* (2013.01); *A61H 2201/169* (2013.01); *A61H 2201/1664* (2013.01); *A61H 2201/1676* (2013.01); *A61H 2205/108* (2013.01); *A61H 2209/00* (2013.01); *A61H 2230/60* (2013.01)

(58) Field of Classification Search
CPC .... A61H 23/0254; A61H 1/005; A61H 1/006; A61H 1/008; A61H 2201/0157; A61H 2201/1418; A61H 2201/165
See application file for complete search history.

(56) References Cited

U.S. PATENT DOCUMENTS

| | | | | |
|---|---|---|---|---|
| 5,575,761 | A | 11/1996 | Hajianpour | |
| 6,620,117 | B1 | 9/2003 | Johnson et al. | |
| 8,100,841 | B2 | 1/2012 | Rousso | |
| 8,795,210 | B2 | 8/2014 | Talish et al. | |
| 2007/0055188 | A1 | 3/2007 | Avni et al. | |
| 2008/0119764 | A1 | 5/2008 | Song et al. | |
| 2008/0125679 | A1* | 5/2008 | Ezenwa | A61H 1/005 601/49 |
| 2008/0146980 | A1 | 6/2008 | Rousso et al. | |
| 2010/0179459 | A1* | 7/2010 | Koch | A61H 1/005 601/53 |
| 2011/0294635 | A1 | 12/2011 | Morris | |
| 2012/0010049 | A1 | 1/2012 | Amalaha | |

(Continued)

OTHER PUBLICATIONS

Grosse, Scott D., Incidence-based cost estimates require population-based incidence data. A critique of Mahan et al., doi:10.1160/TH11-09-0666 Thromb Haemost 2012; 107:192-193.

(Continued)

*Primary Examiner* — Kristen Matter
(74) *Attorney, Agent, or Firm* — Baker & Hostetler, LLP

(57) ABSTRACT

A muscle fiber excitation system (MFES) to execute multiple displacements in each of a vertical, a medial-lateral, and an anterior-posterior direction. The device may be step-on or wearable. In use, the device stimulates muscles to ameliorate the risk of blood clots and muscular-skeletal decline.

20 Claims, 13 Drawing Sheets

(56) References Cited

U.S. PATENT DOCUMENTS

2014/0163439 A1 6/2014 Uryash et al.
2014/0343468 A1* 11/2014 Ezenwa ..... A61H 1/005
601/134

OTHER PUBLICATIONS

Nursing Times, Anti-embolism Stockings, Apr.10, 2011.
Centers for Disease Control and Prevention, (2012). Deep vein thrombosis (dvt) / pulmonary embolism (pe)—blood clot forming in a vein: Data and statistics. Retrieved from website: http://www.cdc.gov/ncbddd/dvt/data.html.
Autar, R. (1996). Nursing assessment of clients at risk of deep vein thrombosis (DVT): The Autar DVT scale. Journal of Advanced Nursing, 23, 763-770.
Ozsu, S., Oztuna, F., Bulbul, Y., Topbas, M., Ozlu, T., Kosuku, P., Ozsu, A. (2011). The role of risk factors in delayed diagnosis of pulmonary embolism. American Journal of Emergency Medicine, 29(1), 26-32.
Ezenwa, B., Burns, E., Wilson, C. (2008). Multiple vibration intensities and frequencies for bone mineral density improvement. 30th Annual International Conference for the IEEE Engineering in Medicine and Biology Society, Vancouver, Canada.
Ezenwa, B., Yeoh, H. (2011). Multiple vibration displacements at multiple vibration frequencies stress impact on human femur computational analysis. Journal of Rehabilitation Research and Development, 8, 179-189.
Medline Plus. (Jan. 1, 2013). Deep venous thrombosis. Retrieved from http://www.nlm.nih.gov/medlineplus/ency/article/000156.htm.
Snow, V., Qaseem, A., Barry, P., et al. (2007). Management of venous thromboembolism: A clinical practice guideline from the American College of Physicians and the American Academy of Family Physicians. Annals of Internal Medicine. 146(3), 204-210.
Gray, G., & Ash, A.(2006). A survey of pregnant women on the use of graduated elastic compression stockings on the antenatal ward. Journal of Obstetrics and Gynecology, 26(5), 424-428.
Kahn, S., Azoulay, L., Hisch, A., Haber, M., Strulovitch, C., Shrier, I. Effect of graduated elastic compression stockings on leg symptoms and signs during exercise in patients with deep venous pre-thrombosis: a randomized cross-over trial. Journal of Thrombosis and Haemostasis, 1, 494-499, date=pre-May 13, 2014.
Liu, R., Kwok, Y., Li, Y., Lao, T., Zhang, X. (2005). Objective evaluation of skin pressure distribution of graduated elastic compression stockings. Dermatologic Surgery, 31(6), 615-624.
Lord, R., & Hamilton, D. (2004). Graduated compression stockings (20-30 mmHg) do not compress leg veins in the standing position. ANZ Journal of Surgery, 74, 581-585, date=pre-May 13, 2014.
Kamphuisen, P., Agnelli, G., Sebastianelli, M. (2005). Prevention of venous thromboembolism after acute ischemic stroke. Journal of Thrombosis and Haemostasis, 3, 1187-1194.
Unay, K., Akan, K., Sener, N., Cakir, M., Poyanli, O. (2009). Evaluating the effectiveness of a deep-vein thrombosis prophylaxis protocol in orthopaedics and traumatology. Journal of Evaluation in Clinical Practice,15(4), 1356-1294.
Wang, H., Tang, W., Tsai, M., Sun, S., Li, Y,. Gilman, B., Kroll, M., Guan, J., Brewer, J., Weil, M. (2009). Coronary blood flow produced by muscle contractions induced by intracardiac electrical CPR during ventricular fibrillation. PACE, 32, s223-s227.
Boushel, R. (2010). Muscle metaboreflex control of the circulation during exercise. Acta Physiologica,199(4), 367-383.
Madarame, H., Kurano, M., Takano, H., Iida, H., Sato, Y., Ohshima, H., Abe, T., Ishii, N., Morita, T., Nakajima, T. (2010). Effects of low-intensity resistance exercise with blood flow restriction on coagulation system in healthy subjects. Clinical Physiology and Functioning Imaging, 30, 210-213.
Kingma, I., van Dieen, J. (2009). Car driving with and without a movable back support: Effect on transmission of vibration through the trunk and on its consequences for muscle activation and spinal shrinkage. Ergonomics, 52(7), 830-839.
Ahlborg, L., Andersson, C., Julin, P. (2006). Whole body vibration training compared with resistance training effect on spasticity, muscle strength, and motor response in adults with cerebral palsy. Journal of Rehabilitation Medicine, 38, 302-308.
Brazier, J., Harper, R., Munro, J., Walters, S., Snaith, M. (1999). Generic and condition-specific outcome measures for people with osteoarthritis of the knee. Rheumatology, 38, 870-877.
Davies, G., Watson, D., Bellamy, N. (1999). Comparison of the responsiveness and relative effect size of the Western Ontario and McMaster Universities Osteoarthritis Index and the Short-Form Medical Outcomes Study Survey in a randomized clinical trial of osteoarthritis patients. Arthritis Care & Research,12, 172-179.
Bachmeier, C., March, L., Cross, M., et al. (2001). A comparison of outcomes in osteoarthritis patients undergoing total hip and knee replacement surgery. Osteoarthritis and Cartilage, 9(2), 137-146.
Angst, F., Aeschlimann, A., Steiner, W., Stucki, G. (2001). Responsiveness of the WOMAC Osteoarthritis Index as compared with the SF-36 in patients with osteoarthritis of the legs undergoing a comprehensive rehabilitation program. Annals of the Rheumatic Diseases, 60, 834-840.
Söderman, P., & Malchau, H. (2000). Validity and reliability of Swedish WOMAC osteoarthritis index. Acta Orthopaedica Scandinavica, 71(1), 39-46.
McGrory B J, Harris W H. Can the Western Ontario and McMaster Universities (WOMAC) Osteoarthritis Index be used to evaluate different hip joints in the same patients? J Arthroplasty 1996; 11: 841-4.
Fareed J Adiguzel C. Thethi I. Differentiation of parenteral anticoagulants in the prevention and treatment of venous thromboembolism. Thrombosis Journal 2011, 9:5.
Linkins L, O'Donnell M, Julian JA, Kearon C. Intracranial and fatal bleeding according to indication for lonng-term oral anticoagulant therapy. Journal of Thrombosis and Haemostasis, 8: 2201-2207, 2010.
Chan ALF, Leung HWC, Wu JW, Chien TW. Risk of Hemorrhage Associated with Co-Prescriptions for Ginkgo biloba and Antiplatelet or Anticoagulant Drugs. The Journal of Alternative and Complementary Medicine vol. 17, No. 6, 2011, pp. 513-517.
Whole-Body Vibration Therapy for Osteoporosis [http://www.effectivehealthcare.ahrq.gov/ehc/products/268/640/Vibration%20Technical%20Brief-Draft.pdf, date=pre-May 13, 2014.
Best practices preventing deep vein thrombosis and pulmonary embolism. http://www.outcomesumassmed.org/DVT/best_practice/, date=pre-May 13, 2014.
Boelig MM, Streiff MB, Hobson DB, Kraus PS, Pronovost PJ, Haut ER (Jun. 2011). "Are sequential compression devices commonly associated with in-hospital falls? A myth-busters review using the patient safety net database". J Patient Saf 7 (2): 77-79.
Dobesh PP. Economic burden of venous thromboembolism in hospitalized patients. Phamacotherapy. Aug. 2009: 29(8): 943-953. Doi: 10. 1592/phco.29.8.943.
Caprini JA1 , Botteman MF, Stephens JM, Nadipelli V, Ewing MM, Brandt S, Pashos CL, Cohen AT. Economic burden of long-term complications of deep vein thrombosis after total hip replacement surgery in the United States. Value Health. Jan.-Feb. 2003;6(1):59-74.
MacDougall DA1, Feliu AL, Boccuzzi SJ, Lin J. Economic burden of deep-vein thrombosis, pulmonary embolism, and post-thrombotic syndrome. Am J Health Syst Pharm. Oct. 15, 2006;63(20 Suppl 6):S5-15.
CDC Grand Rounds: Preventing hospital-associated venous thromboembolism Morbidity and Mortality Weekly Report Weekly Mar. 7, 2014.
Blann AD. Venous thromboembolism. BMJ. Jan. 28, 2008, 332(7535): 215-219.
Venous thromboembolism in adult hospitalizations—United States, 2007-2009. Centers for Disease Control and Prevention (CDC). MMWR Morb Mortal Wkly Rep. Jun. 8, 2012;61(22):401-404.
CLOTS 3 Study Delivers Lifesaving Results Using Covidien's Blood Clot Prevention Technology, Clinical Trials Week, Jul. 1 2013.

(56) References Cited

OTHER PUBLICATIONS

Lederle, FA, et. al., "Venous thromboembolism prophylaxis in hospitalized medical patients and those with stroke: a background review for an American College of Physicians Clinical Practice Guideline," Annals of Internal Medicine, vol. 155, Issue 9, pp. 602-615, Nov. 2011.

Kakkar, A.K. and S.K. Rushton-Smith, "Incidence of Venous Thromboembolism in Orthopedic Surgery," Thromboembolism in Orthopedic Surgery, Springer-Verlag London, 2013.

Dangi, Raghuraj Singh, "Continuous Enhanced Circulation Therapy (CECT)—Prevention of Deep Vein Thrombosis (DVT)," Market Research Solution @ Niche Markets, 2009. http://raghurajsingh.blogspot.nl/2009/03/continuous-enhanced-circulation-therapy.html.

* cited by examiner

MUSCLE FIBER EXCITATION SYSTEM FOR PREVENTING BLOOD CLOT AND MUSCULAR-SKELETAL DECLINE

CROSS-REFERENCE TO RELATED APPLICATIONS

This application is a continuation-in-part of U.S. Ser. No. 14/277,028 filed May 13, 2014, which is expressly incorporated by reference herein in its entirety.

STATEMENT REGARDING FEDERALLY SPONSORED RESEARCH

This invention was made possible in part with government support under 1R43HL115916-01A1 grant awarded by National Institutes of Health.

BACKGROUND

The National Institutes of Health reports that each year 2,000,000 Americans develop deep venous thrombosis (DVT). Of these, about 600,000 are hospitalized for pulmonary embolism (PE) and 60,000 are fatal. Degenerative muscle fiber condition and diminishing muscle contraction performance are factors associated with aging, diabetes, obesity, inactivity, and life style factors including unhealthy nutrition. Left untreated, these factors could result in peripheral blood pooling and the development of PE or DVT. Peripheral blood pooling and associated diminished blood circulation has other consequences such as inadequate delivery of nutrition and oxygen to parts of the body including the brain, and that could result in mild cognitive impairment with progression to Alzheimer's disease. A method to counter these negative factors to human health irrespective of individual mobility status and without side effects is not available.

Medication to prevent blood clot include blood thinners (anticoagulants) such as heparin and warfarin (Coumadin); aspirin as oral and liquid antiplatelet agents; low-molecular-weight heparin Dalteparin (FRAGMIN®), Enoxaparin (LOVENOX®) and Tinzaparin (INNOHEP®) heparin sodium unfractionated heparin; Factor Xa inhibitors Fondaparinux (Arixtra®) Rivaroxaban (XARELTO®); and Vitamin K antagonists. While the thinning action prevents coagulation and thereby prevents blood clots, there is great potential that increased bleeding following surgery, excessive bleeding from injuries, and internal bleeding could occur.

Devices to prevent blood clots include compression stockings to reduce swelling by compressing the leg and keeping blood flowing; intermittent pneumatic compression device to inflate and deflate with air pump to squeeze the leg; and venous foot pump to inflate and deflate with air pump to increase blood flow in the leg. However, mechanical compression therapy exemplified by U.S. Pat. No. 6,123,681 does not improve the decline in the physiologic system such as fading motor unit activation and muscle fiber excitability. Effectiveness may depend on the level and state of individual adipose tissue even when transportability of the device is guaranteed. None of these mechanical devices are as effective as the pharmaceutical drugs described above, and the devices may be noisy and patients are prevented from ambulation during use. These contradictions draw consistent complaints from patients leading to lack of compliance and inability to overcome the intended problem described above. Electrical stimulation devices have found use in prevention of DVT. The device disclosed in U.S. Pat. No. 6,226,552 "Neuromuscular electrical stimulation (NES) in prevention of deep vein thrombosis," is intended to conduct electrical current to a patient's limb, contracting the superficial muscles. In U.S. Pat. Nos. 6,181,965; 6,175,764; and 6,051,017, implantable micro-stimulators are disclosed. While NES systems use less electrical current intensity and are thus more tolerable than painful functional electrical stimulation (FES) models, the NES method is invasive and requires surgery for implanting NES thin-film electrodes. Prolonged use of implanted thin film electrodes could suffer fatigue problems from mechanical stress as surrounding muscles strengthen, and thermal stress could occur when electric charges are not fully conducted away before the next inflow of current thereby creating local heating that may continue to build up along the electrode thin films. When the combined mechanical and thermal stress overcome the thin-film strength of materials, the thin films will breakdown and enter the individual's blood stream.

Physical exercise by the actions of contracting muscles during therapy has been proven to prevent blood clots. However, bed-ridden patients recovering from major surgery and others unable to exercise such as older adults do not take advantage of exercise to prevent blood clots. Therapy such as raising the leg while immobilized have been used, but this will not improve decline in muscle fiber excitability and motor activation due to age and immobility. People unable to exercise due to age or immobilization will be susceptible to blood clots and diminished health.

A whole body vibration (WBV) device was developed to provide exercise to the muscular and skeletal system. Current WBV device philosophy is to cause the displacement of the platform for human support to execute oscillatory vertical movements, or center pivoted platform triangular movements, or triplanar sonic movements. Some have been implemented for use while standing, seated or in bed, and the user has the option to select preferred platform motion frequency and displacement amplitude before use. U.S. Pat. No. 5,070,555 discloses a bed with footboard oscillation, with the footboard adaptable to be attached to either or both sides of a bed; U.S. Pat. No. 7,530,960 discloses a vibration platform having an upper surface and a bottom surface where a reversible motor is mounted and connected to a mounted drive shaft on the bottom surface. Platform motion occurs from unbalanced weight of a rotatable weight eccentrically mounted to the drive shaft in relation to another fixed weight also mounted to the drive shaft. In U.S. Patent No. 2004/0210173 by Swidle, a synchronous impact table with a support system has a control system, a power system coupled to the control system; a lift system coupled to the power system and the support system; and a patient support system coupled to the lift system. However, major drawbacks with applying current WBV devices to overcome problems described above are multi-faceted. There could be bone fracture by increasing the displacement level in order to obtain better outcome, and current WBV devices presents options to users to vary this operating parameter. Muscle fibers have different frequencies. Selected operating frequency may favor the muscle fiber type with twitch frequency close to the selection against other muscle fiber types which is unlike scenario during exercise and may cause tingling sensation. Selection of key therapy parameters at different locations renders standardization impossible.

The problem addressed by the embodiments of the present invention is to provide solutions to the problems described above without contraindications in existing solution methods as described above. The focus is to provide the physiologic system the ability to overcome problems described above safely. Individuals suffering from decline of muscle fiber excitation and motor unit activation due to age, prolonged immobilization following orthopedic and vascular surgery, disease and obesity face the problem of blood pooling that could progress to life threatening deep venous thrombosis, lack of adequate blood circulation, insufficient nutrient and oxygen to vital parts of the body including the brain. Given that no previously known device and method is effective without contraindications, or applicable irrespective of individual mobility status and ability to engage in physical therapy, there is a need for effective therapy device and method in preventing decline in muscle fiber excitation and motor unit activation, to deliver improved muscle contraction, blood flow and bone mineral density.

BRIEF SUMMARY OF THE INVENTION

The inventive muscle fiber excitation system (MFES) provides a device to externally energize muscle fibers at muscle fiber twitch frequencies to improve motor unit activation and muscle contraction, to improve blood flow thereby prevent blood pooling/clot and deep venous thrombosis, and to improve bone mineral density. MFES externally provides muscle fibers optimal excitation stimuli encompassing muscle fiber twitch frequencies. The stimuli set off a sequence of actions of improved motor unit activation leading to improved muscle contraction sufficient to improve blood flow thereby prevent blood pooling and blood clots without side effect therefore differs remarkably from medication. Wearable MFES device is usable and concealable under clothes while mobile and in immobility state, thereby differs from physical exercise and patented mechanical devices described above.

The inventive MFES device and performance include multiple micro displacements 1 mm (minimum) to 4 mm (maximum) of a telescoping platform in vertical (Z), medial-lateral (X), and anterior-posterior (Y) directions per cyclic revolution using 4 donut-like cams, with a cam defined as a rotating or sliding piece in a mechanical linkage used to transform rotary motion into linear motion or vice versa, characterized by surround peaks and troughs with different ascend gradients to the tops and different descend gradients troughs. During assembly, each cam's surround peak and trough of a dimension is aligned out of phase with peak and trough of similar dimension with other cams' peaks and troughs. The outcome result during use is asynchronous contacts of all four cams surround profile on a device telescoping platform thereby delivering non-deterministic quantum displacement stress on the platform that is delivered to the human contact surface. Contrary to user selected displacement height in WBV devices that could predispose brittle bones to potential fractures, MFES fixed 1 mm to 4 mm displacements provides stress on the bone equivalent to walking. Contrary to user selected single operating frequency in WBV devices which is sub-optimal because intact muscle system is composed of muscle fibers with different twitch frequencies, MFES delivers non-deterministic quantum displacement stress within 2 Hz and 130 Hz frequency band, thus providing muscle fibers the twitch frequencies for equal opportunity optimal excitation. User option to select displacement level, or device operating frequency or both with WBV devices creates safety concerns for brittle bones and makes study outcomes at different study stations incomparable. Without the options of selecting the operational displacement levels and frequencies MFES system devices deliver more unit activation, muscle contraction, blood flow improvement and stress on the bone for improved bone mineral density. The forgoing short falls of WBV systems, the associated pain and potential electrode failure in implantable neuromuscular stimulation, the side effects of medication and the inefficiency and patient complaints of compression devices leaves physical exercise as the current viable method to deal with human health improvement including blood pooling prevention, but this will be possible if only the individual is able to and willing to exercise. What is needed is a device that does not provide options to vary the displacement and operating frequency parameters, but operates at safe displacement levels and efficiently energizes all muscle fiber types, each at corresponding twitch frequency to activate motor unites for muscle recruitment and contraction. The current MFES invention differentiates the device from alternatives to fill the need for a safe and effective therapy device and method for preventing decline in muscle fiber excitation, motor unit activation and muscle contraction to safely deliver improved muscular skeletal system and blood flow as summarized in MFES.

FIG. 1A shows technical advantages achieved by providing muscle fiber excitation externally at frequencies that encompass muscle fiber twitch frequencies 2 Hz to 130 Hz while providing safe displacement levels 1 mm to 4 mm. The inventive system accomplishes these with two shafts each affixed with two unique cams. Each shaft is mounted off the device base with two bar-like pillar blocks with plain bearings. The shafts are tied together and to direct current (DC) motor with timing belts over pulleys. MFES also has a platform with four plungers. The plungers are strategically implemented to telescope along matching channels on the bar-like pillar blocks off the device base. Assembled the shafts are rotated with powered DC motor to cause the surround cams profile to make momentary random contacts with the telescoping platform. Use of the principle of quantum scatter at the cams' surround contacts with the telescoping platform underpins the realization of MFES unique performance.

Various embodiments of the invention are specific for attaining system performance effectively and the desired results. Thus, the invention provides CAMs means by which displacement levels of the platform are limited to 1 mm to 4 mm by special design of each ascend to peak and descend to trough around each CAM extremities illustrated in FIG. 1B. Foams with characteristic fast recovery response, such as elastomers for example and without limitation, combined with stiffener and wearable materials was implemented where CAMs make contact with telescoping platform to effect stimuli transfer and cushion the impact to the user at bearable noticeable noise. To enhance MFES performance three factors were considered: the surround peaks and troughs of each CAM have different ascend and descend gradients offering variable time delay factor, each CAM profile is assembled to be out of phase with the other 3 CAMs profiles offering pseudo stochastic performance, and each CAM surround geometry makes very brief contacts with the telescoping platform offering quantum contact effect. The frequency response of the platform to CAMs cyclic contacts is a result of the three factors.

MFES CAMs performance provide pseudo random low displacement levels with brief quantum contacts with the platform causes the platform to telescope, generating low-level displacement (1 mm to 4 mm) platform stress signals at frequency encompassing 2 Hz to 130 Hz transferable to human point of contact. Continuous cyclic CAMs' operation and platform human contacts over time causes continuous low-level displacement signal generation at muscle twitch frequency 2 Hz to 130 Hz to spread from point of platform human contact to distal anatomic locations.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 3A shows the CAM contact side with specially designated 4 contact areas (14) made of a combination of slippery stiffener and fast-recovery foam-like materials, such as foams with elastomers. The contact stress is transferred to the platform other side.

FIG. 3B also shows retractable plunger (15) at the four corners of the platform. On contact with CAMs the platform uses the plungers to execute telescoping actions along strategically created matching channels (TC) on the bar-like pillar blocks off the device base FIGS. 2B and 2C. The telescoping actions along the TC channels are limited to 1 mm to 4 mm displacements in the vertical, medial-lateral, and anterior posterior directions as designed after affixing the device top enclosure.

FIG. 5 is the picture of MFES device closed with top enclosure showing section for fasteners, such as screws (shown), to cover the top 18 and limit telescope activities of the platform's human contact side (17) to flush with the enclosure. Assembly is simple. The 2 shafts are attached to the 4 bearings in the bar-like pillar blocks and tied with timing belt over pulleys attached the shafts with adequate tension. After electrical connection between the input electric jack and DC motor terminals, the DC motor is tied to one of the shafts with another timing belt over a second pulley set. The platform's 4 plungers are inserted into the 4 channels on the bar-like pillar blocks making sure that the stiffener side faces the CAMs. The device cover is engaged with screws. When turned on the MFES CAMs begin to telescope. In the wearable MFES suitable (industrial strength) male-female Velcro combination is used to cover the opposite side of FIG. 5. Equivalently, a selected section of a belt is implemented with male-female Velcro combination but making sure that the open MFES Velcro will mate with the belt open Velcro. With DC power jack on. In the MFES large standing form factor FIG. 1B the human contact side covers the entire top surface. For both the wearable and standing MFES, the impact of the CAMs on the platform and the net stress are similar.

FIG. 9 shows the frequency bandwidth as in FIG. 8 20 Hz to 250 Hz of the net muscle fiber excitation effect delivered to the telescoping platform human contact side, for onward transmission to the physiologic system in any form factor, demonstrates implementable by trained professional in the art. Either way the effect on muscle contraction compared to without MFES (baseline) is similar.

FIGS. 11A and 11B are images of blood flow through popliteal artery and vein vessels before wearable MFES was turned ON over the quadriceps muscles (30) with subject lying down; and 10 seconds after MFES was turned OFF (31). Blood flow was measured with clinical diagnostic ultrasound system and definitely show increased blood flow after MFES was turned off compared to before it was turned ON.

DETAILED DESCRIPTION

Figure 1A:
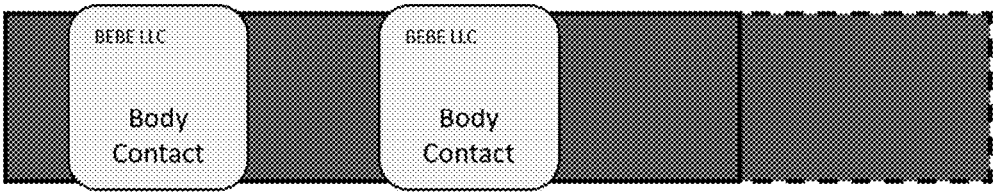
FIG. 1A is a picture of wearable MFES device worn with belt and a system of male and female Velcro to enable variable positioning along the belt, and configuration as a single unit or cascaded units. Wearable MFES weighs 118-130 grams, with dimensions of 6 cm in width, 6 cm in length and 2.5 cm height, and human body contact section to deliver stimuli originating from device 4 CAMs. In the MFES large form factor model FIG. 1B that weighs 40 Lbs the human body contact area is the top used for standing. Wearable or standing MFES device key component is the CAM.
Figure 1B:
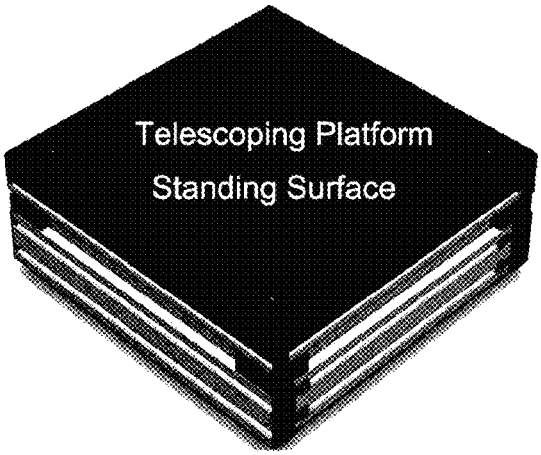

MFES invention externally delivers multiple displacement nodes 1 mm to 4 mm maximum per cycle within pre-determined and fixed frequency bandwidth such as 2 Hz to 250 Hz (or 20 Hz to 250 Hz when ripples are included) implemented in the standing model and 2 Hz to 130 Hz (or 2 Hz to 250 Hz when ripples are included) in the wearable model as excitation stimuli to improve muscular and skeletal system declines and to prevent blood clots. The ripple effect of the frequency bandwidth is similar to the ripples from a stone thrown in water. MFES device comprises an enclosure with 2 bar-like pillar blocks from the base. Each pillar block has 2 strategically implemented bearings and 2 channel openings from the top. MFES device also comprises of 2 shafts each affixed with pulley arrangements and matching timing belts at one end, and 2 CAMs (rotating donut-like shaped mechanical construction towards the other end) each with unique surround peaks of varying heights and ascend gradients, and troughs of varying depths with varying descend gradients. MFES also comprises of a platform with combination of slippery stiffener and foam material on one side, compliant material on the other side, and a plunger at each of the four corners. A top with opening to transmit therapeutic stimuli and counter sink holes and screw arrangements is used as cover.

To assemble, the two shafts are attached to the four bearings in the bar-like pillar blocks and tied with timing belt over pulleys attached the shafts with adequate tension. After electrical connection between the input electric jack and DC motor terminals, the DC motor is tied to one of the shafts with another timing belt over a second pulley set. The platform's four plungers are inserted into the four channels on the bar-like pillar blocks making sure that the stiffener side faces the CAMs. The device cover is engaged with screws. Two models of MFES device, the wearable model and the standing model are identical in innovation philosophy. They differ in size, wearable model is 6 cm by 6 cm by 2.5 cm and weighs 118 grams but can range from 100 g to 130 g depending on the material used to construct. Preferably it should weigh 118 g or less. In one embodiment, the standing model is 40.64 cm by 40.64 cm by 13.97 cm, and weighs 46 pounds.

In the large form factor standing model, beneath the top enclosure are fast-acting recovery composite material combination with stiffener materials strategically positioned for the revolving CAMs to make contact during cyclic rotation. Standing surface is prepped with non-skid material. This constitute the telescoping platform and it covers all the top surface. In the wearable model, the top enclosure sandwiches a platform comprising of a side with fast-acting recovery composite material combination with stiffener material strategically positioned for the revolving CAMs to make contact during cyclic rotation, and a compliant opposite side for human contact which flushes with the enclosure. The contact side is made from materials with properties to prevent local skin shear. For example, such materials may be foam materials with elastomers and a leather cover. The body contact stress is less than 0.002 g. A belt and Velcro arrangements are used to wear one or more wearable units as desired.

The nodal displacement are pre-determined and fixed by design and the frequency bandwidth is fixed to encompass muscle fiber twitch frequencies. By delivering low-intensity stress as stimuli at the desired muscle fiber excitation twitch frequencies to a user continuously over a period of time, muscle fibers are energized to activate more motor units to recruit more muscle contraction, thereby improving muscle contraction, bone mineral density, and blood flow. Fixing nodal displacement to safe level and frequency that encompass muscle fiber frequencies is intended to deliver gradual recovery and to be safe to fragile bone and cartilage. The following examples will further the understanding of the exemplary nature of MFES in any of its models.

Exemplary Nature of the Embodiment. Because in the art of quantum mechanics stress transfer is recognized, one may recognize from the embodiment substantially equivalent structures or substantially equivalent acts may be used to achieve the same results in exactly the same way, or to achieve the same results in a not dissimilar way, the embodiment should not be interpreted as limiting the invention to one embodiment.

Likewise, individual aspects of the invention (such as media-lateral, anterior-posterior and vertical platform excursions) are provided as examples, and, accordingly, one of ordinary skill in the art may recognize from exemplary performance that an equivalent performance may be used to either achieve the same results in substantially the same way, or to achieve the same results in a not dissimilar way.

Accordingly, it is recognized that as technology develops, a number of additional alternatives to achieve an aspect of the invention may arise. Such advances are hereby incorporated within their respective aspects of the invention, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as essential.

Third, a function or an act should be interpreted as incorporating all modes of doing that function or act, unless otherwise explicitly stated.

Fourth, unless explicitly stated otherwise, conjunctive words such as "or", "and", "including", or "comprising" should be interpreted in the inclusive, not the exclusive, sense explicitly described and identified as essential.

Fifth, muscle fiber function or an act or characteristics in the forgoing should be interpreted as common to all mammals' humans and animals alike or act, unless otherwise explicitly stated. Unless explicitly stated otherwise, conjunctive words such as "or", "and", "including", or "comprising" should be interpreted in the inclusive, not the exclusive, sense are covered my MFES technology.

Specific Methods

This invention in any of the embodiment mode delivers displacement nodes and excitation stimuli to a user in the same specific pattern always. Accordingly, the embodiment application method is specific and independent of the mode implemented. The stimuli frequency span is fixed to specifically energize all muscle fibers, and there is no option to vary the frequency span.

In any of the invention embodiment mode each muscle fiber type is energized at corresponding twitch (resonance) frequency. Muscle fiber excitation at twitch frequency result in increased motor unit activation. Accordingly, muscle contraction is increased.

In the invention embodiment increased muscle contraction apply pressure on blood vessels and momentarily vary blood volume flow, velocity and circulation. Accordingly, increased muscle contraction improves blood circulation.

In the invention embodiment the stress from platform displacement and the stress from muscle contraction apply more stress on the bone matrix. Accordingly, increased stress on bone matrix enable influx of bone nutrients for improved bone mineral density and strength.

Figure 2A:
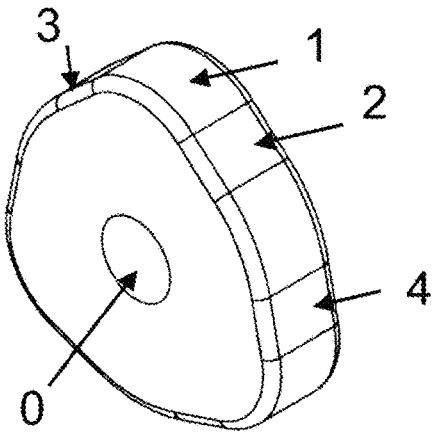
FIG. 2A illustrates one of the four CAMs used in the MFES device enlarged to show smooth and complex surround peaks and troughs geometric profile. Each peak such as (01) measured from the CAM center (0) has different height than other peaks. Each troughs such as (02) measured from the center (0) has different depth than other troughs. Each ascend gradient to peak such as (03) has a different profile than other ascend gradients, and each descend gradient to trough such as (04) has different profile than other descend gradients. Thus the CAM surround profile intentionally designed to present non-deterministic contact surface through one complete revolution was realized. The unique 4-CAM assembly is critical to MFES performance.
Figure 7A:
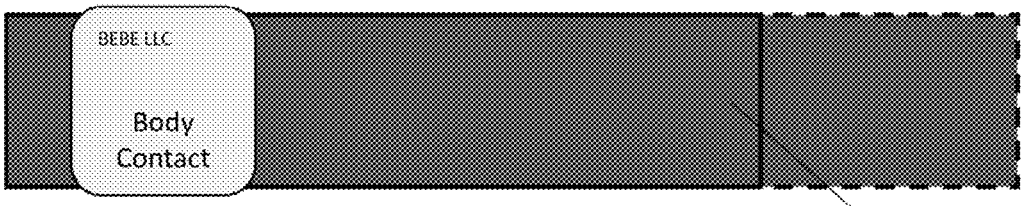
FIGS. 7A and 7B are photographs of wearable MFES device with continuous adjustable belt and Velcro combinations (23) for wearing over desired section of the body, as a single unit FIG. 7A or in cascades FIG. 7B. Other configurations are possible.
Figure 7B:
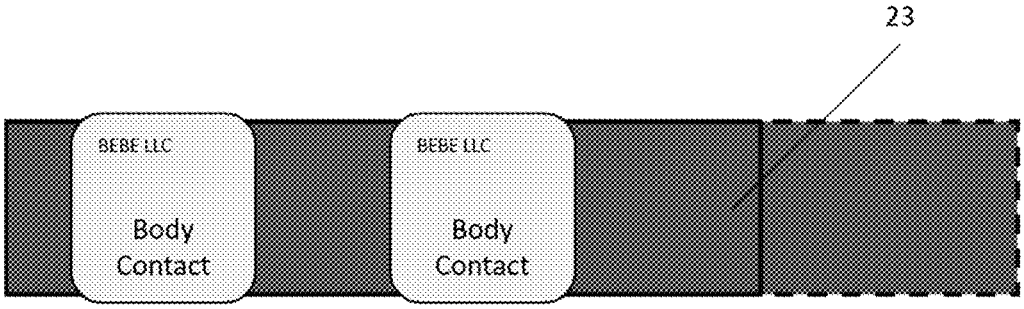
Figure 7C:
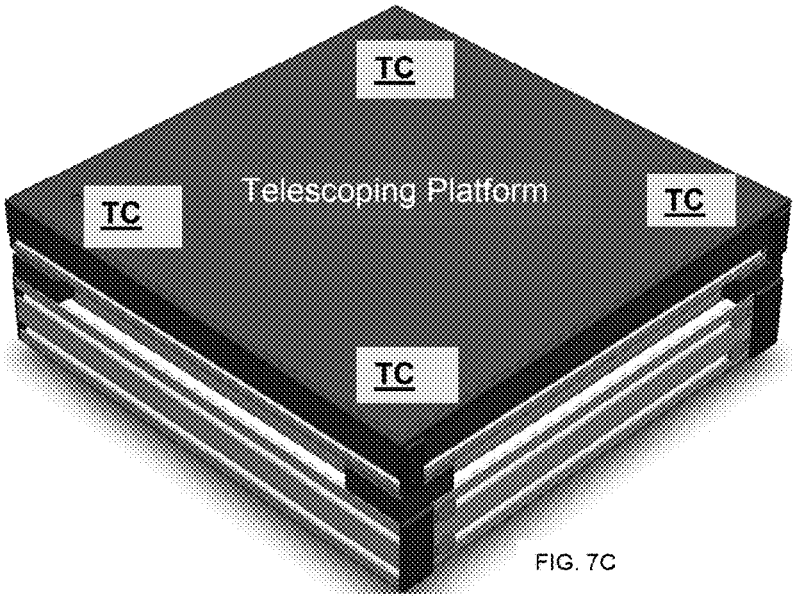
FIG. 7C is a photograph of larger form factor of MFES device easily derived from FIG. 2B with the telescoping platform designed to cover the top providing standing area for stimuli delivery.

FIG. 7A is a picture of the wearable muscle fiber excitation system (MFES) usable as a single unit or in cascades (more than one) FIG. 7B. FIG. 7C is the picture of the standing model. MFES was developed to energize muscle fibers externally by delivering 3-D displacement nodes 1 mm to 4 mm maximum FIG. 6 (19, 20, 21), at frequency band that encompass muscle fiber twitch frequencies FIGS. 8 and 9 with a system of 4 CAMs such as FIGS. 2C and 7D. As a result, optimally energized muscle fibers sets off a sequence of events that start by improving motor unit activation to improved muscle contraction as in FIG. 10A with the subject lying down and FIG. 10B with the subject standing up. These lead to the squeeze of blood vessels resulting in improved blood flow FIGS. 11 and 12. These effects are realizable whether an individual is mobile or immobile. Muscle fiber excitation stimuli originates from the shape of MFES CAM embodiment FIG. 2A, enlarged to show CAM surround peaks and troughs of different ascent to peaks and descent to troughs geometries. Each ascend gradient to peak such as (03) has a different profile from other ascend gradients, and each descend gradient to trough such as (04) has different profile from other descend gradients. MFES was redesigned to attain the concept of equality in orthogonal stimuli stress delivery intended for blood flow improvement. The redesign called for CAM peak and the troughs gradients to be varied with the intent to reduce vertical displacement, the peaks widened to achieve micro time delay. The redesign also called for restricting vertical displacement of MFES telescoping platform to control impact on skin surface, and providing telescoping platform shafts (plungers) succinct channel diameter to execute 3-D telescoping actions in response to CAM contacts below. The ascend and descend profiles comply with the associated frequency window, which is critical to recruit muscle fibers. The surround profile of a CAM was intentionally designed to present non-deterministic contact surfaces through one complete revolution as the CAM makes contact with the platform's CAM contact side FIG. 3A. The combined effects of displacement nodes FIG. 6 (19, 20, 21) on the telescoping platform CAM contact side FIG. 3A, the net effect FIG. 6 (22) are transmitted to the platform human contact side FIG. 3B (17). The muscle fibers twitch from optimal excitation frequency band delivery FIGS. 8 and 9, muscle contract applying stochastic net stress on bone matrix for improved bone mineral density, as well as squeeze sandwiched blood vessels to improve blood flow. The components and assembly embodiments inside the MFES device were designed to achieve the two intended goals; eliminate periodicity but support stochastic response of the telescoping to facilitate realization of the excitation frequency band of interest 2 Hz to 130 Hz for the wearable model and 2 Hz to 250 Hz for the standing model.

Figure 2B:
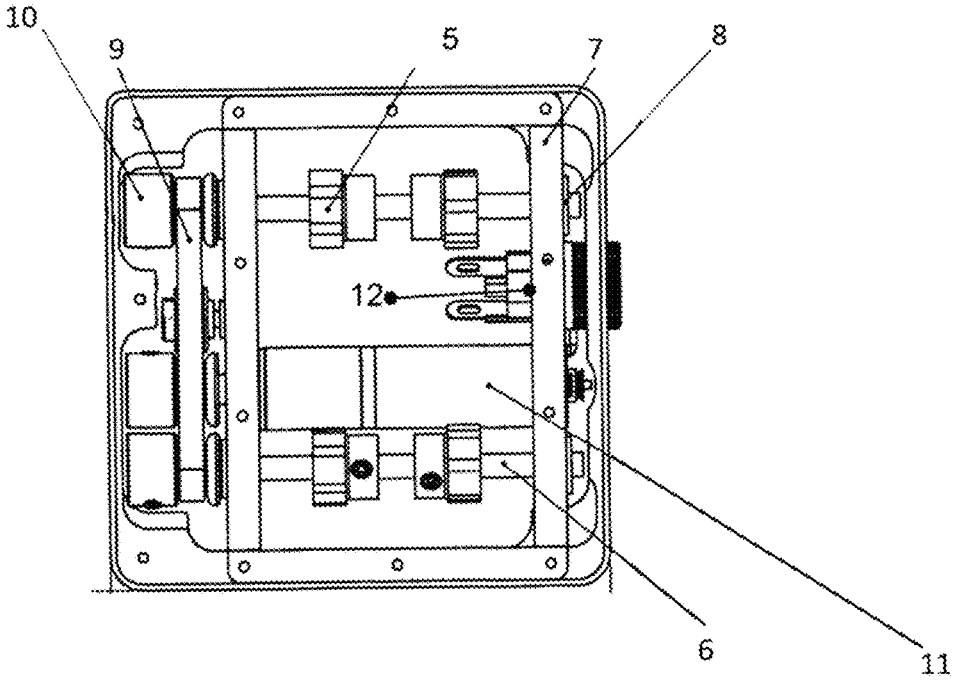
FIG. 2B and FIG. 2C illustrate inside embodiments in the MFES device design, both opened and enlarged for clarity. Inside the MFES device comprises a shaft such as (06) affixed with 2 CAMs such as (05), and a second shaft affixed with the same number of CAMs. Each shaft is supported with a bar-like pillar blocks (07) with bearings (08) off the device base. The shafts are connected with a timing belt (09) through 2 system of pulleys (10) with bearings and a second timing belt connecting the shafts to gear-coupled DC motor (11) also with pulleys. The DC motor powered through input jack (12) between the two shafts causes shafts rotating the four CAMs that originates the therapeutic stimuli that is transferred to the human body.
Figure 2C:
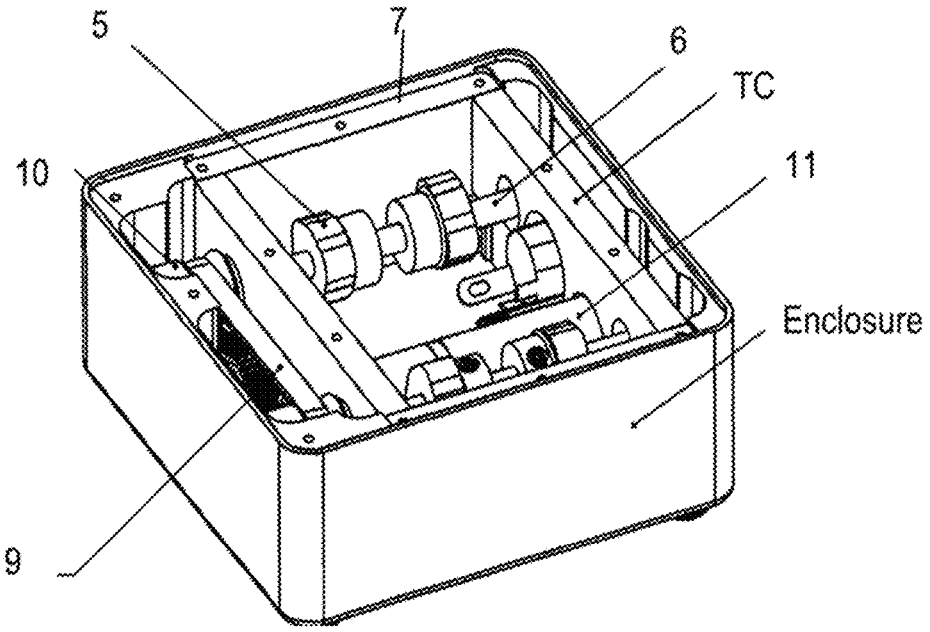

FIG. 2B illustrates top view inside design embodiments of the MFES device, and FIG. 2C is top view photograph of MFES inside components. Two shafts (6) were used, each affixed with 2 CAMs (5) and mounted off the device base with bar-like pillar blocks (7) with bearings (8). Each CAM features surround peaks of various heights each with different accent gradients, and between peaks are troughs of various depths each with different descant gradients. The CAMs are affixed so that a peak height of a CAM is out of phase with equivalent peak height of the other three CAM, thus eliminating deterministic responses from contacts with the telescoping platform. The two shafts are connected with timing belt (9), driven with pulley arrangement (10) by DC motor (11) at the device base connected to DC power supply (12). As the shafts are rotated through cyclic motions, the CAMs surround geometries make contact with a platform allowed to engage in telescope actions.

Figure 3A:
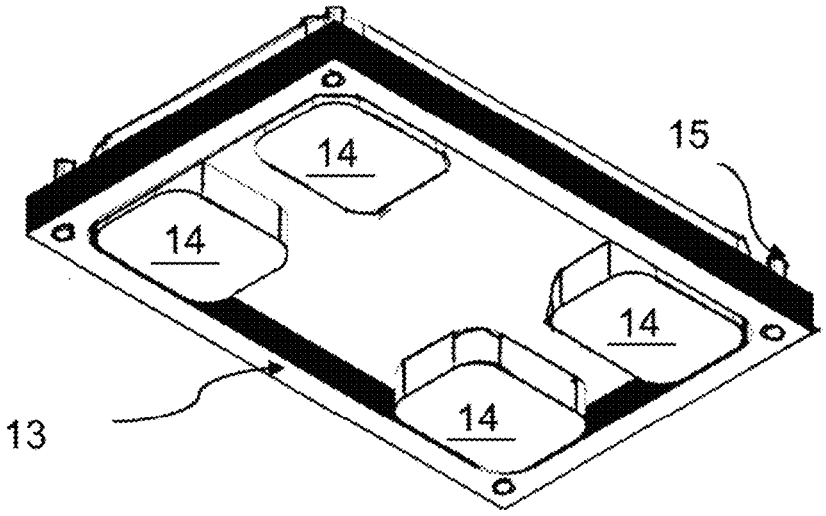
FIG. 3A illustrates the embodiment of 2-sided platform structure (13) component of the MFES device.
Figure 3B:
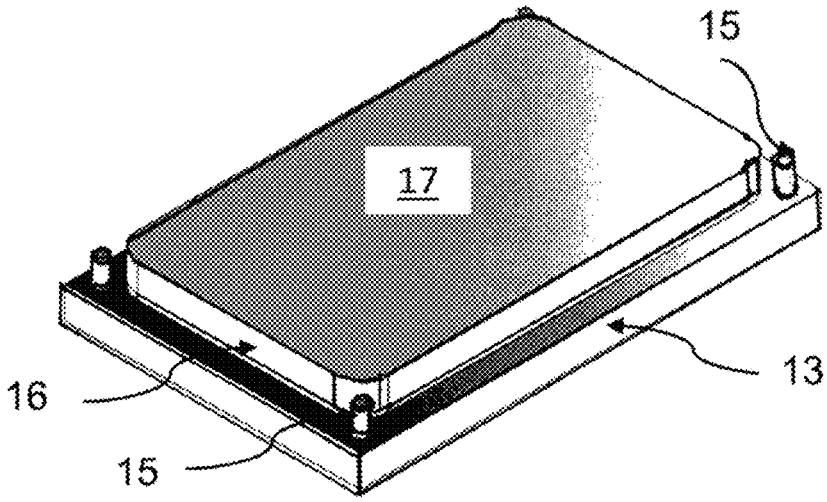
FIG. 3B illustrates the MFES device platform structure (13) other side, the human contact side (17) made of compliant material (16).

FIGS. 3A and 3B illustrate the design embodiments of the MFES device telescoping platform. Below the platform FIG. 3A are four fast acting recovery composite materials (14) each strategically located to make contact with one of the 4 CAMs during a cyclic motion. Each CAM's surround extremities make multiple pseudo random brief contacts with corresponding fast recovery acting compliant material beneath the platform (14) delivering multiple brief quantum contact during a cyclic motion. CAMs' contacts cause the platform to use the 4 mini plungers (15) at the platform corner frame to execute telescoping actions along matching channels (TC) along the bar-like pillar blocks off the device base.

Figure 4:
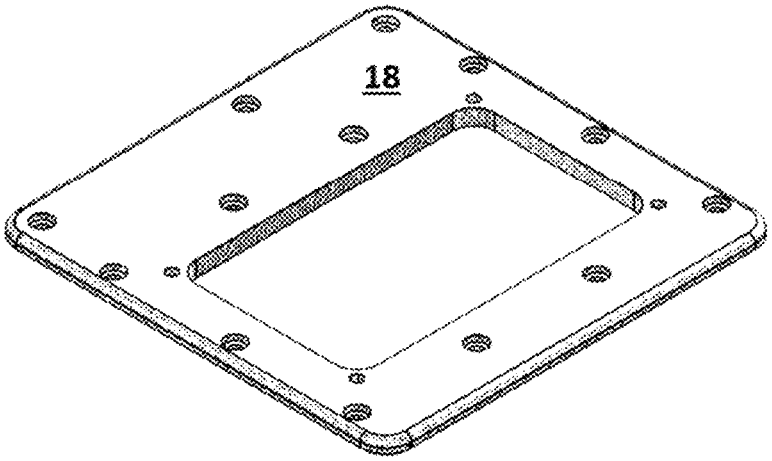
FIG. 4 illustrates MFES device top enclosure 18 showing matching counter sink holes for tying the top enclosure to MFES device structure illustration FIG. 2B and picture FIG. 2C and the opening for platform limited telescoping activities.
Figure 5:
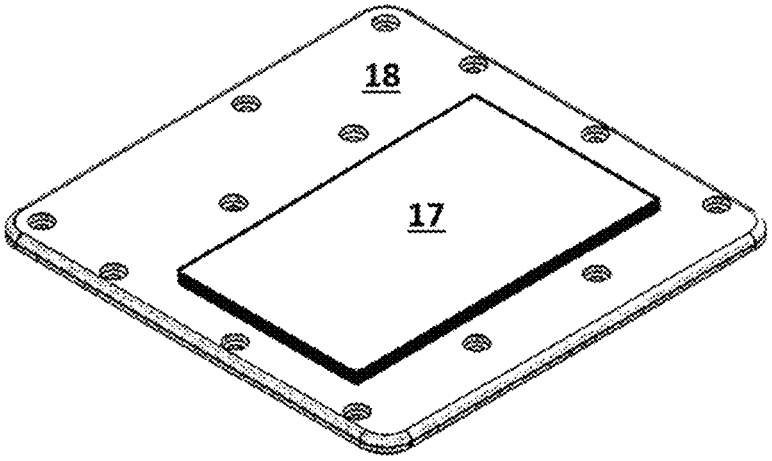
Figure 6A:
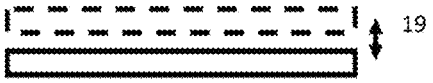
FIGS. 6A-6D illustrate the effects of MFES CAMs' contact on the telescoping platform stiffener contact side per cycle of revolution. Shown in FIG. 6A is the effect in the vertical (19); medial-lateral (20) in FIG. 6B; anterior-posterior (21) in FIG. 6C; and net effect (22) in FIG. 6D transmitted to the human contact side is stochastic. In the wearable embodiment MFES is belted to the body with the compliant side making contact with the body. In the standing embodiment an individual stands on the human compliant side. MFES can be configured for use in different form to achieve the desired object.
Figure 6B:
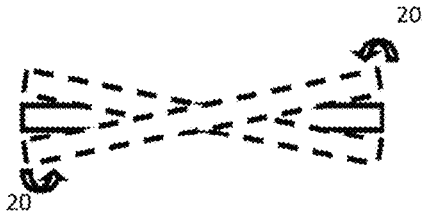
Figure 6C:
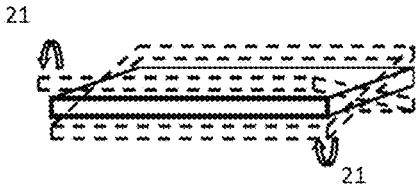
Figure 6D:
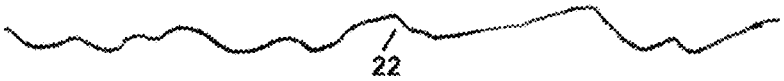
Figure 7D:
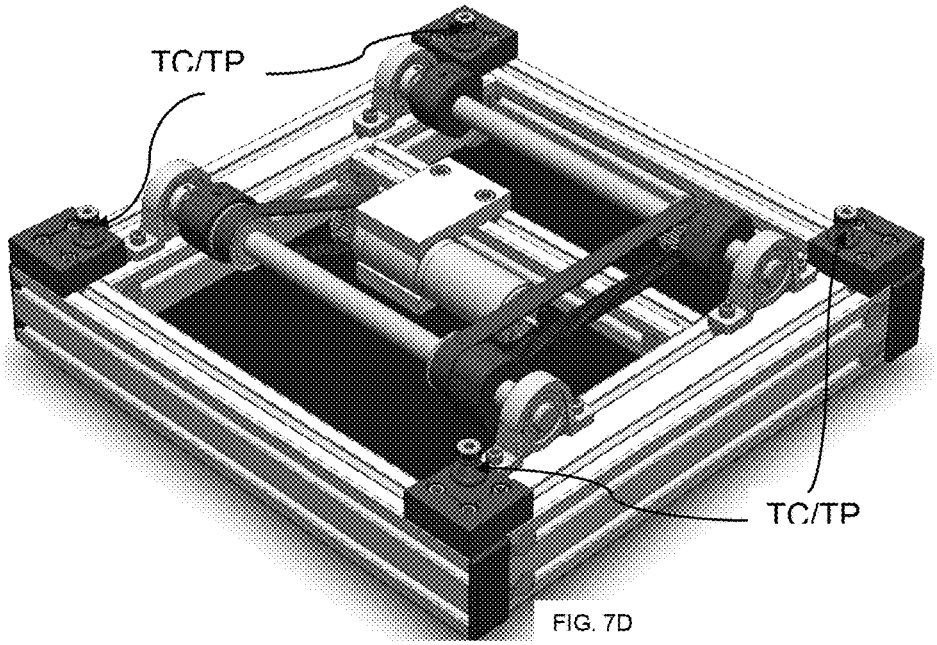
FIG. 7D is FIG. 7C open illustrating implementation by a skilled technician underneath a seating surface or inclined bed leg rest or the bed. In any configuration while the displacements are limited to 1 mm to 4 mm in 3D to frequency bandwidth at construction can be set and fixed.

Wearable MFES final assembly FIG. 5 is accomplished by inserting the telescoping platform and recessing the four plungers of FIG. 3B (15) into the four channels (TC) of FIG. 2C, before closing the MFES top with MFES top enclosure FIG. 4 with the platform human contact side FIG. 3B (17) flush with the top cover. The wearable MFES top enclosure is secured tight with recess screws as in FIG. 5. A fastener such as but not limited to Velcro is used to attach a belt to the opposite side of FIG. 5 for wearing one unit or more. Standing MFES device open FIG. 7D is equivalent in form to the wearable MFES device open FIG. 2B except for one key component. In FIG. 2B a telescoping plunger (15) and matching telescoping channel (TC) are implemented separately. In FIG. 7D a telescoping plunger (TP) and the matching telescoping channel (TC) are implemented (TC/TP) so that a plunger is fixed to the device base while a matching channel telescopes about it. In the standing model, each channel has a cap at one end used to provide threaded screw fastening of the device top, and for securing the channel structure through O-rings that allow only 1 mm to 4 mm maximum displacements. The final assembly of the standing MFES device model is accomplished by securing device top four threaded screws to the four channel head matching threaded screw arrangements FIG. 7D. The key performance indicators of both the wearable and standing MFES systems, the platform induced stress and nodal displacements are identical.

The stress on the platform from the pseudo non-deterministic quantum 4-CAM contact on the platform CAM-contact side is transmitted to the CAM body contact side. The CAM surround geometry iteratively optimized to deliver a frequency band that encompass muscle fiber twitch frequencies 2 Hz to 130 Hz per cyclic revolution in the wearable model and 2 Hz to 250 Hz in the standing model is delivered to the body for use in therapy. A continuously adjustable belt provides wearable model a means for the device to be engaged with the comfortable top of the platform (17) in contact with the human body, when an individual just stands on top of the standing model. The displacement nodes and each frequency band parameters are fixed upon assembly and cannot be varied after. Compressive force triggers system short down because the MFES was not designed for load bearing. The embodiments of the present MFES invention and methods accomplishes blood clot prevention by preventing blood pooling; muscular system decline by improving motor unit activation and muscle contraction; skeletal system decline by improving bone mineral density, and muscular system decline by improving muscle fiber excitability for more motor unit activation and muscle contraction recruitment.

Figure 13:
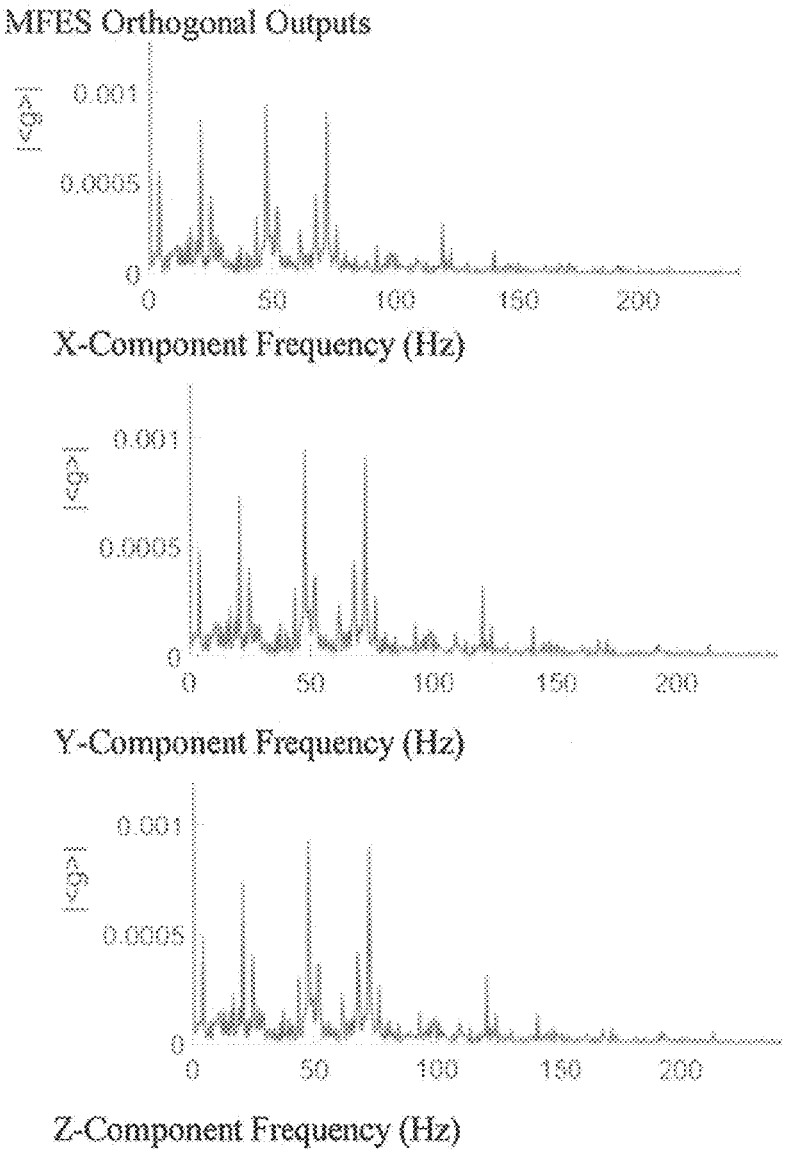
FIG. 13 shows orthogonal outputs of the MFES. The study was conducted to verify MFES stimuli stress delivery patterns and magnitudes. A Data Translation Triaxle accelerometer ADXL335 rigidly mounted to a mini test jig and attached to the top of MFES telescoping system was used to sense the stress delivery patterns and magnitudes related to the telescoping displacement patterns. The accelerometer is connected to a Data Translation data acquisition system, DT9839E, and connected to a computer. MATLAB 2015 by MathWorks Inc. USA was next used for data analysis producing the orthogonal x, y, z components that exhibited equality in magnitude in all directions as designed. The rationale for equal magnitude in stress delivery directions is to accomplish transcutaneous stimuli delivery to both peripheral and deep muscle groups. MFES telescoping contact stress magnitude less than 0.001 g in engineering gravitational units will not affect skin surface integrity.

FIG. 6 illustrates the embodiments of the MFES device CAM contact effect on the platform as it telescopes in 3D, the plungers executes displacements about 0 to ±3 deg in the vertical (19), medial-lateral (20), anterior-posterior (21) directions. FIG. 13 shows the orthogonal outputs. The net stress effect FIG. 6 (22) is transmitted to the platform human contact side and delivered to muscle fibers as nodal stimuli 1 mm to 4 mm maximum at the operating frequency band 2 Hz to 250 Hz for the standing model and 2 Hz to 130 Hz for the wearable model. Each frequency band is achieved through CAMs' ascend-descend gradients and optimal sizing between the plungers and the telescope channels (TC) that varies the friction between them, thus furthering the stochastic contact pattern between the CAMs and the platform plungers.

FIG. 7A shows photo of assembled single MFES wearable model device with continuous adjustable belt and Velcro (23), and FIG. 7B cascaded double MFES wearable model devices for concurrent use. Thus the wearable MFES device provides unique flexibility of use in any orientation along upper or lower body or limb extremities, and the standing model FIG. 7C is extendable to use at bedside or while seated.

Figure 8:
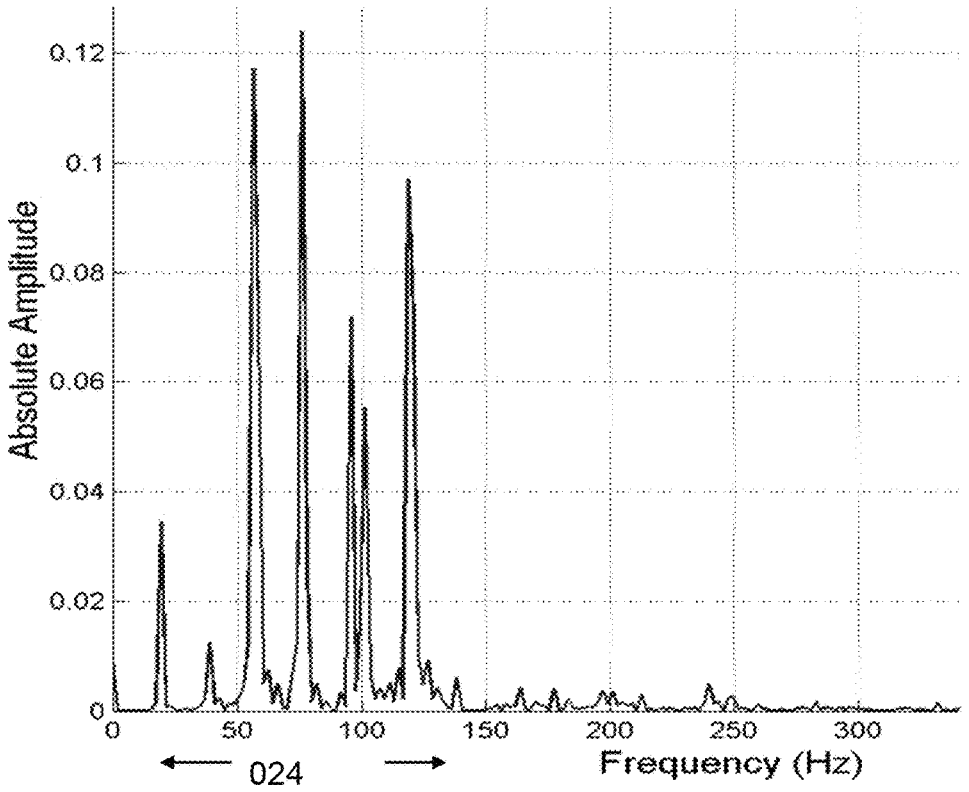
FIG. 8 shows the frequency bandwidth 20 Hz to 130 Hz (24) of the net muscle fiber excitation effect (22) in FIG. 6, delivered to the telescoping platform human contact side for onward transmission to the human contact side in any MFES form factor model.
Figure 9:
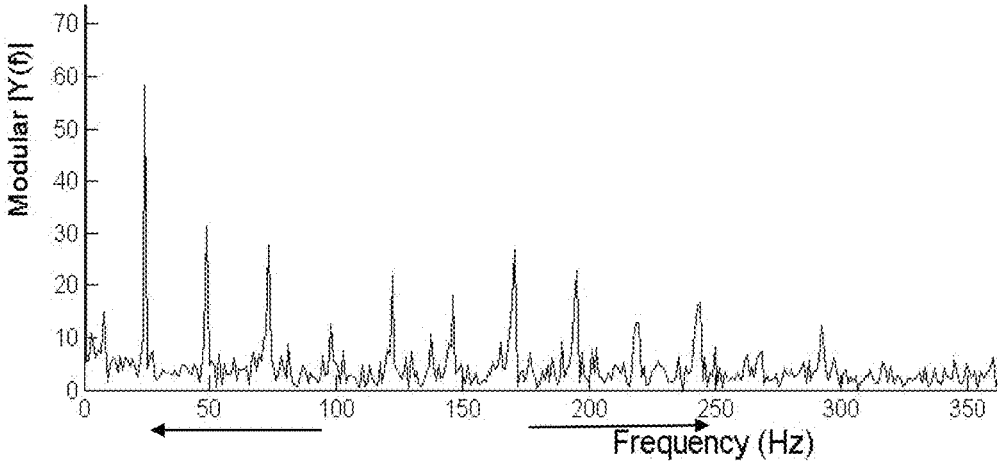

FIGS. 8 and 9 show the frequency component of the standing MFES CAM contact effects FIG. 8 and wearable MFES FIG. 9 on the platform delivered to the body contact surface. Encompassing the twitch frequencies of muscle fibers triggers a sequence of improved motor unit activation, muscle contraction and increased pressure on blood vessels for increased blood flow results.

Figure 10A:
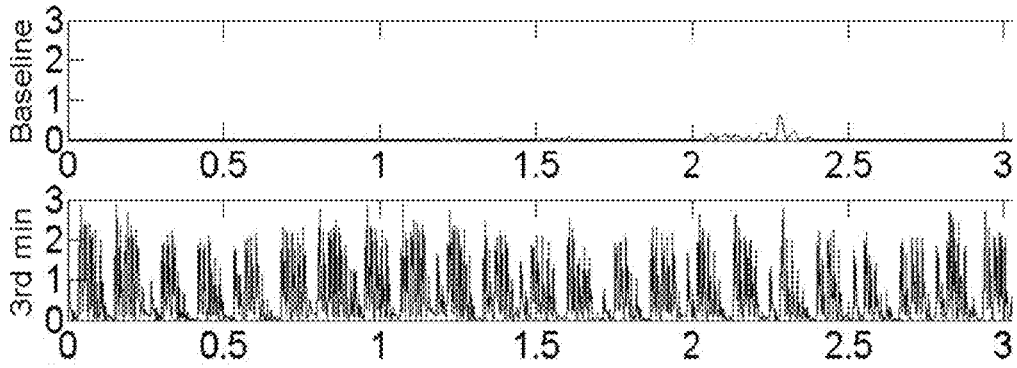
FIG. 10A is the measured quadriceps muscle EMG before wearable MFES was turned ON (Baseline) with the subject lying down, and measured EMG in the third minute ($3^{rd}$ minute) of continuous MFES delivery with the subject still lying down.
Figure 10B:
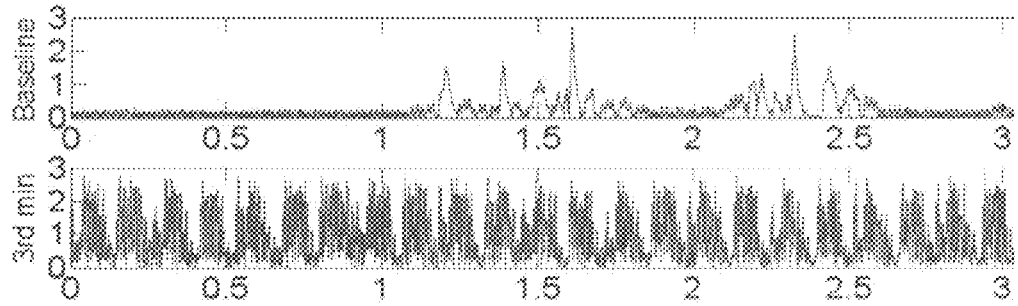
FIG. 10B is the measured quadriceps muscle EMG before standing model MFES was turned ON (Baseline) with the subject on the device, and measured again in the third minute ($3^{rd}$ minute) of continuous MFES delivery with the subject still standing on the device. More clusters of EMG suggest increased motor unit activation, and higher EMG signals than baseline for a person lying down or standing show increased in muscle contraction. Although the level of EMG is less than during voluntary muscle contraction, which is not the intent of this invention. The intent was to prevent muscular and skeletal decline because of age and immobility due to medical conditions such as major surgery, and to improve blood flow to prevent blood pooling and blood clots that were tested.

FIG. 10A shows gastrocnemius muscle electromyography (EMG) of a person standing on the standing MFES device before the device was turned ON (Baseline) and FIG. 10B a person wearing the wearable MFES over the gastrocnemius muscle before the device was turned ON (Baseline). In the third minute after the device was turned ON in each case the muscle EMG measurements was again taken. With MFES turned ON, muscle contraction at the third minute of continuous MFES stimuli delivery in each case was greater than baseline. Compared to baseline in each case, EMG clusters when MFES was turned on were more in both cases indicative of more motor units being activated when MFES was turned on. This demonstrates that compared to baseline MFES device activated more motor units and muscle contraction compared to baseline, a condition similar to a person in immobilized state. MFES embodiment and methods can be used to improve muscle activities in persons able and unable to ambulate including a person who is immobilized which has application on preventing blood pooling.

Figure 11A:
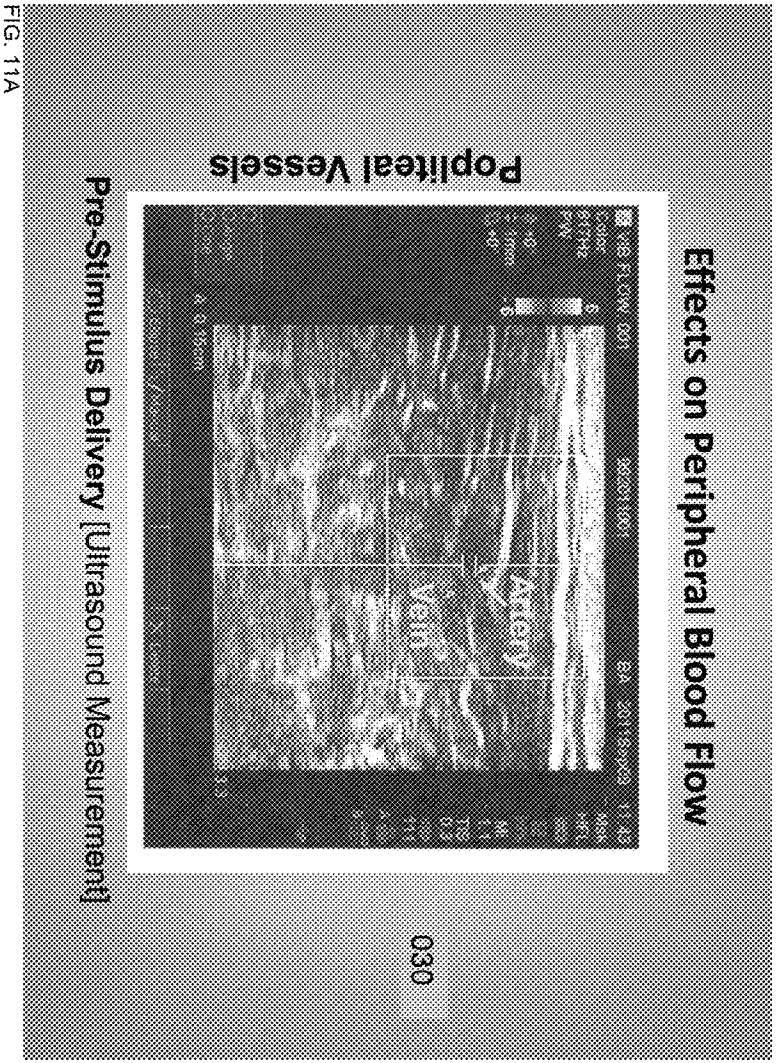
Figure 11B:
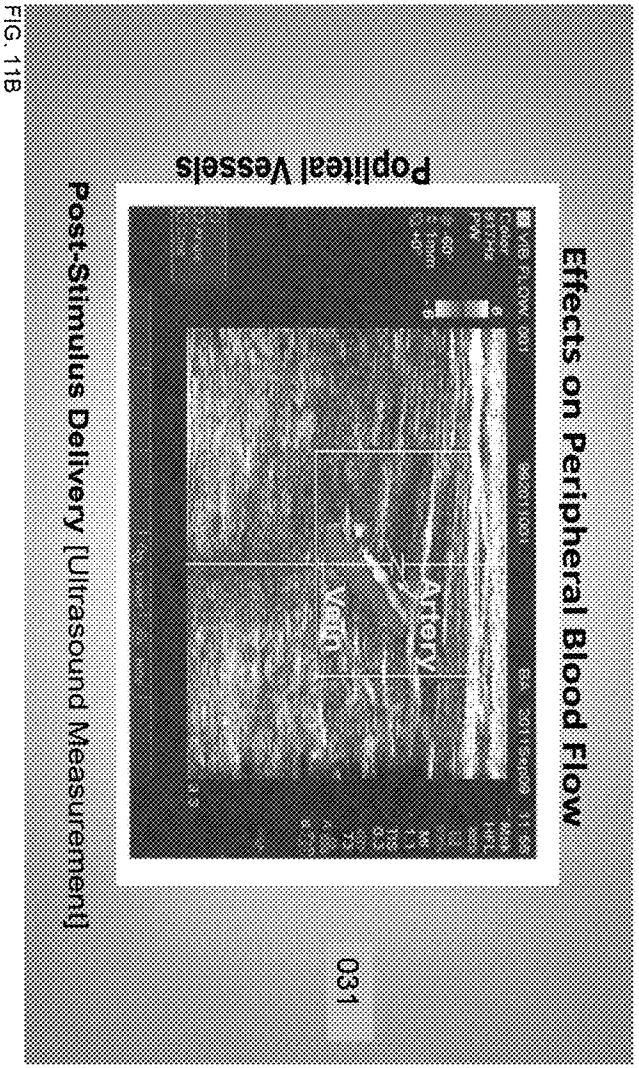

FIG. 11A shows ultrasound measurement of peripheral blood flow along the popliteal vessels for a person wearing the MFES over the quadriceps muscles (30) before MFES was turned ON and FIG. 11B one minute after MFES was turned OFF (31). The artery vessel in yellow, vein in purple were larger after MFES stimuli deliver than before demonstrates that the increase in muscle contraction reflected increase in blood flow along the popliteal blood vessel.

Figure 12A:
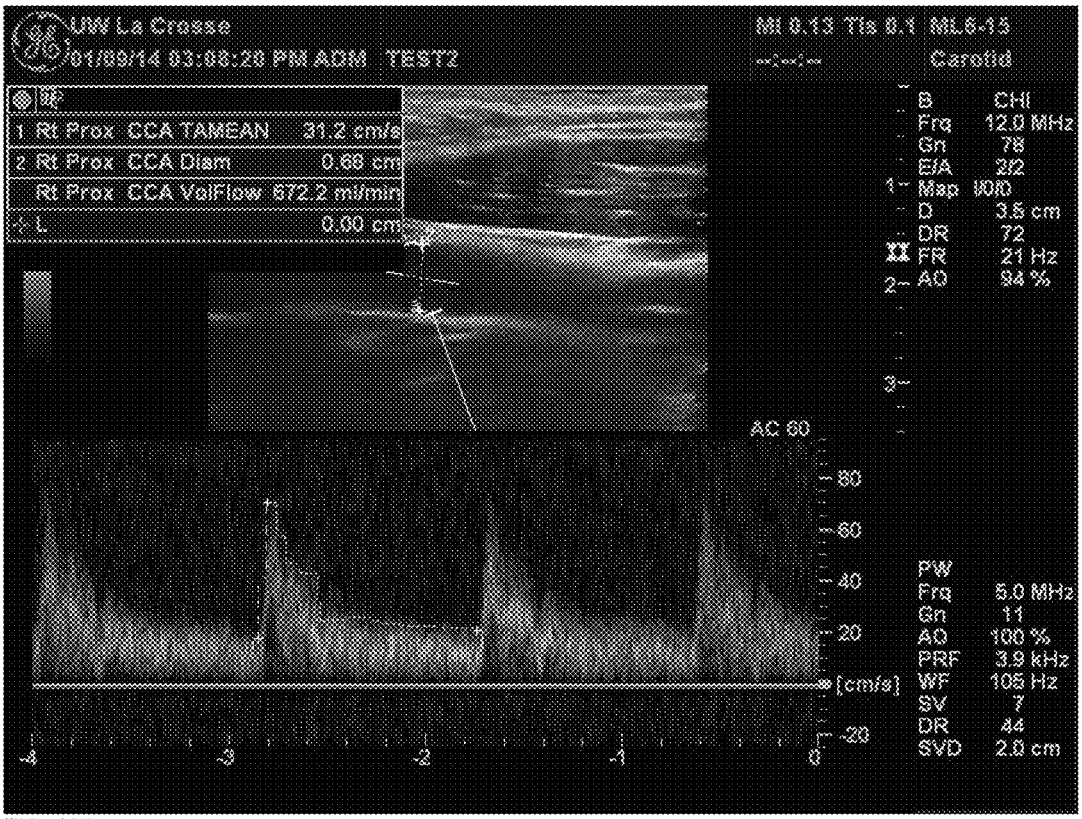
FIGS. 12A and 12B are images of blood flow through carotid vessels before wearable MFES was turned on over the trapezoid muscles with subject lying down FIGS. 12A; and 10 seconds soon after wearable MFES was turned off FIG. 12B. Blood flow was measured with clinical diagnostic ultrasound system. It was considered important to conduct measurements when MFES is on. Again, wearable MFES continued to show improved blood flow after it was turned off in peripheral blood vessel and main blood flow to the brain.
Figure 12B:
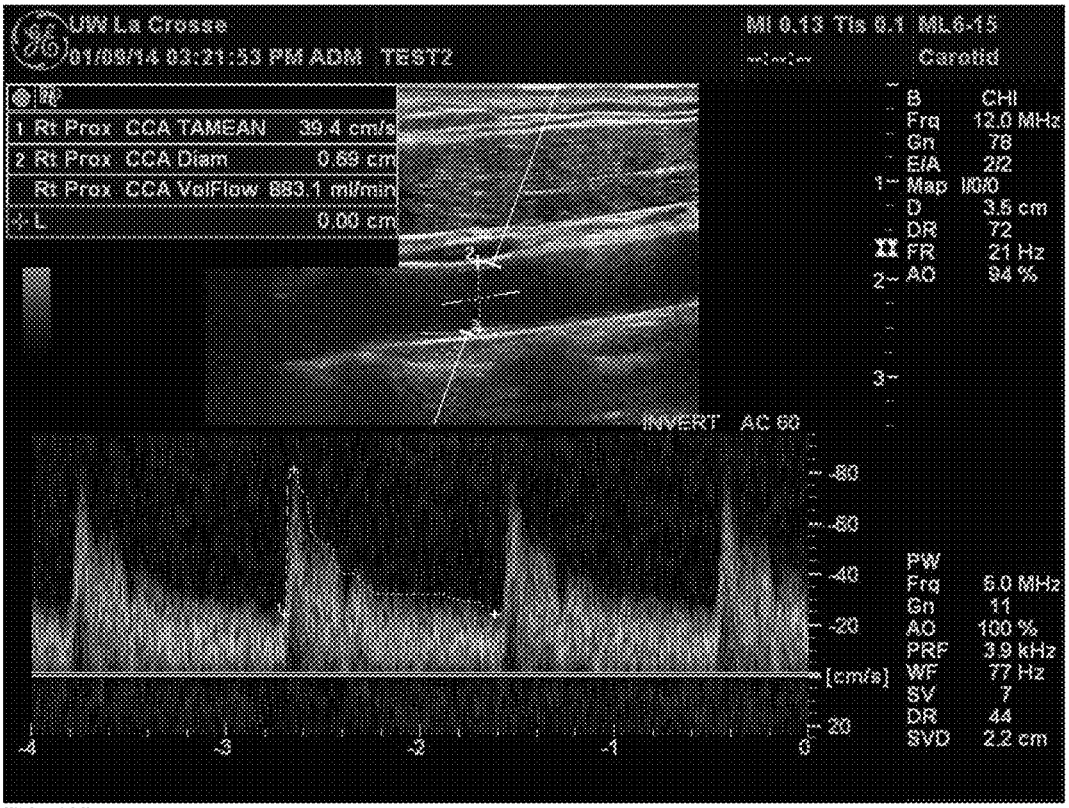

FIGS. 12A and 12B shows ultrasound measurement of carotid blood flow with a subject wearing MFES device over the trapezoid muscle group lying down, before MFES was turned on FIG. 12A, and 20 seconds after MFES was turned off FIG. 12B. Results show MFES can be used in the lower and upper body segments alike. Standing MFES system has been demonstrated to improve bone mineral density.

The bone mineral density improvement demonstrates the outcomes targeted in the design: to apply sufficient vertical stress to the skeletal system to support influx of bone minerals into bone matrix for bone strength remodeling and strengthening. To prevent telescoping shaft binding along the vertical telescoping channels, the diameter of the channel was set slightly larger than the telescoping shaft diameter, and therefore the preponderance of force applied to the telescoping platform was used for vertical displacement magnitude.

In contrast, the wearable MFES is designed to attain the concept of equality in orthogonal stimuli stress delivery intended for blood flow improvement without adversely affecting the skin surface. CAM peaks and troughs gradients were designed to reduce vertical displacement, and the peaks were widened to achieve micro time delay. Further, the telescoping platform vertical displacement range was restricted to control impact on skin surface, and the telescoping platform shafts (plungers) were provided succinct channel diameter to enable equal execution of 3-D telescoping actions in response to CAM contacts below. This is crucial in the design because equal magnitude orthogonal displacement, i.e. x, y, z, displacements, is suitable for MFES stimuli to penetrate deep, for example to the superficial lower back and between vertebrae muscles. It achieves the intent of assisting a physiological system perform the process of blood flow improvement by energizing the muscle fibers. The MFES test was conducted in the frequency domain, if the x-, y-, z-components were different in magnitude, the magnitudes will be different in magnitude in the frequency domain.

The embodiments shown and described in the specification are only specific embodiments of inventors who are skilled in the art and are not limiting in any way. Therefore, various changes, modifications, or alterations to those embodiments may be made without departing from the spirit of the invention in the scope of the following claims. The references cited are expressly incorporated by reference herein in their entirety.

What is claimed is:

1. A muscle fiber excitation system (WES) for use in stimulating circulation to ameliorate formation of a blood clot and to prevent muscular-skeletal decline in a patient, the system comprising:

a) an enclosure comprising a base and two pillar blocks, wherein the pillar blocks each comprise a first and a second channel, the first and the second channel comprising bearings, the pillar blocks being parallel to each other such that the first channel on the first pillar block is aligned with the first channel on the second parallel pillar block and the second channel on the first pillar block is aligned with the second channel on the second parallel pillar block;

b) a first and a second shaft, each shaft affixed with two cams, wherein the first shaft is mounted in the first channels of the first and second pillar block and the second shaft is mounted in the second channels of the first and second pillar block, the first and second shafts being rotatably mounted off the enclosure base in the bearings in the channels of the pillar blocks;

c) a direct current motor mounted within the enclosure, the direct current motor being operably linked to a power source, and being configured to drive at least one timing belt, wherein the at least one timing belt is coupled to the first and the second shaft such that operation of the direct current motor drives the timing belt and thereby rotates the first and the second shafts;

d) four plungers, each plunger being positioned at a corner of the enclosure; and e) a telescoping platform configured to be mounted on the enclosure, the telescoping platform having a patient contact surface, a cam contact surface, and four telescoping plunger channels, each channel being configured to receive one of the four plungers, wherein the cam contact surface comprises one or more cam contact areas aligned with one or more of the cams within the enclosure;

wherein operation of the direct current motor rotates the shafts and each cam affixed thereto, causing rotation of the cams and subsequent contacting of the respective cam contact areas of the telescoping platform, wherein each of the two cams affixed to each shaft is unique and comprises peaks of varying heights and ascend gradients, and troughs of varying depths and descend gradients, wherein each cam is assembled to be out of phase with the other cams, and wherein the system is configured to execute multiple displacements of equal magnitude in each of a vertical, a medial-lateral, and an anterior-posterior direction.

2. The system of claim 1, wherein the cam contact surface of the telescoping platform further comprises a fast-recovery foam in combination with a stiffener.

3. The system of claim 1, wherein the patient contact surface comprises a compliant composite material.

4. The system of claim 1, wherein each cam has a different ascend and a different descend gradient.

5. The system of claim 1, wherein each cam is affixed to have peak heights out of phase with equivalent peak heights of the other cams, thereby preventing coincident contact of the cam profiles of equivalent ascend and descend gradients.

6. The system of claim 5, wherein the out of phase peak heights of the cams causes asynchronous pseudo random quantum contact of the cam profiles with the telescoping platform.

7. The system of claim 6, wherein the asynchronous pseudo random quantum contact yields a non-deterministic stress profile of the telescoping platform.

8. The system of claim 7, wherein the stress profile of the telescoping platform creates an operating frequency band of about 2 Hz to about 250 Hz.

9. The system of claim 6, wherein the stress profile results in cyclic muscle contraction and release.

10. The system of claim 1, wherein the displacements are limited to about 1 mm to about 4 mm within a cycle, a cycle being one revolution of a cam.

11. The system of claim 1, wherein the system is implemented as part of a bed, a chair, or a standing unit.

12. The system of claim 11, further comprising at least one handrail.

13. The system of claim 11, further comprising at least one wheel.

14. The system of claim 11, wherein the system is 40.64 cm by 40.64 cm by 13.97 cm.

15. The system of claim 1, wherein the system is implemented to be wearable.

16. The system of claim 15, wherein the wearable system is an adjustable belt.

17. The system of claim 15, wherein operation of the direct current motor causes asynchronous pseudo random contact of the cams with the telescoping platform to yield a non-deterministic stress profile frequency of 2 Hz to 130 Hz.

18. The system of claim 15, wherein the system is 6 cm by 6 cm by 2.5 cm.

19. The system of claim 1, wherein the multiple displacements are fixed.

20. The system of claim 1, wherein the system is handheld.

* * * * *